US011268524B2

(12) United States Patent
Darry et al.

(10) Patent No.: US 11,268,524 B2
(45) Date of Patent: Mar. 8, 2022

(54) METHOD FOR CONTROLLING A PLURAL STAGE COMPRESSOR

(71) Applicant: CRYOSTAR SAS, Hesingue (FR)

(72) Inventors: Marina Darry, Mulhouse (FR); Cyril Heliot, Hundsbach (FR)

(73) Assignee: CRYOSTAR SAS, Hesingue (FR)

( * ) Notice: Subject to any disclaimer, the term of this patent is extended or adjusted under 35 U.S.C. 154(b) by 220 days.

(21) Appl. No.: 16/608,331

(22) PCT Filed: Apr. 5, 2018

(86) PCT No.: PCT/EP2018/058704
§ 371 (c)(1),
(2) Date: Oct. 25, 2019

(87) PCT Pub. No.: WO2018/197174
PCT Pub. Date: Nov. 1, 2018

(65) Prior Publication Data

US 2021/0285452 A1 Sep. 16, 2021

(30) Foreign Application Priority Data

Apr. 27, 2017 (EP) ..... 17168535

(51) Int. Cl.
*F04D 17/12* (2006.01)
*F04D 27/02* (2006.01)

(52) U.S. Cl.
CPC ..... *F04D 17/12* (2013.01); *F04D 27/0215* (2013.01)

(58) Field of Classification Search
CPC .... F04D 17/12; F04D 17/122; F04D 27/0207; F04D 27/0215; F04D 27/0223
See application file for complete search history.

(56) References Cited

U.S. PATENT DOCUMENTS 4,464,720 A * 8/1984 Agarwal ..... F04D 27/0207 415/1
4,949,276 A * 8/1990 Staroselsky ..... F04D 27/0284 700/282

(Continued)

FOREIGN PATENT DOCUMENTS

WO 2010/012559 A2 2/2010
WO 2015/132196 A1 9/2015

OTHER PUBLICATIONS

International Search Report dated Jun. 13, 2018 issued in corresponding PCT/EP2018/058704 application (3 pages).

*Primary Examiner* — Brian P Wolcott
*Assistant Examiner* — Jackson N Gillenwaters
(74) *Attorney, Agent, or Firm* — Millen White Zelano & Branigan, PC; Brion P. Heaney

(57) ABSTRACT

Method for controlling a plural stage compressor comprising at least a first stage (10), a second stage (20) and a first inter-stage line (12) between the first stage (10) and the second stage (20), comprising the steps of:

Figure 1:
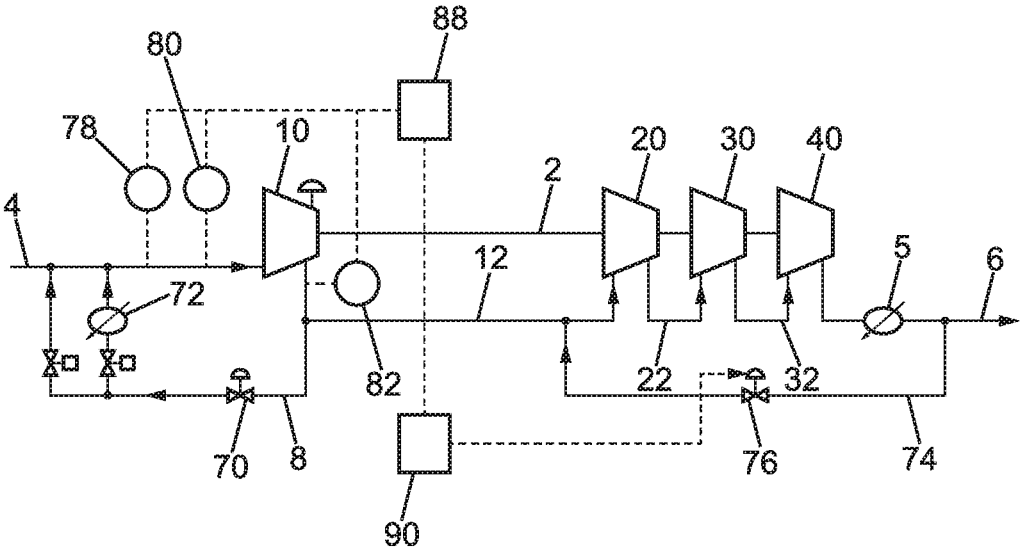

a—measuring the temperature at the inlet of the compressor, b—measuring the ratio between the outlet pressure (Pout) and the inlet pressure (Pin) of the first stage (10) of the compressor, c—calculating a coefficient (ψ) based at least on the value of the inlet temperature (Tin) and on the measured pressure ratio (Pout/Pin), d—if the calculated coefficient (ψ) is in a predetermined range, acting on a control valve (70; 76; 92) mounted in a line (4; 8) supplying the inlet of the first stage (10) of the compressor or in a gas recycle line (74) which opens into the first inter-stage line (12).

14 Claims, 2 Drawing Sheets

(56) References Cited

U.S. PATENT DOCUMENTS

| | | | | |
|---|---|---|---|---|
| 5,743,715 | A * | 4/1998 | Staroselsky | F04D 27/0269 417/6 |
| 6,332,336 | B1 * | 12/2001 | Mirsky | F01D 15/08 62/613 |
| 8,532,830 | B2 | 9/2013 | Van Dijk | |
| 9,074,606 | B1 * | 7/2015 | Moore | F04D 19/02 |
| 10,215,183 | B2 * | 2/2019 | Uresin | F04D 27/006 |
| 10,254,719 | B2 * | 4/2019 | Shapiro | G05B 11/42 |
| 2011/0130883 | A1 | 6/2011 | Van Dijk | |
| 2011/0229303 | A1 * | 9/2011 | Winkes | F04D 17/12 415/1 |
| 2012/0011857 | A1 * | 1/2012 | Becker | F02C 6/08 60/806 |
| 2016/0047392 | A1 | 2/2016 | Bernocchi et al. | |
| 2017/0074274 | A1 | 3/2017 | Gallinelli et al. | |

* cited by examiner

METHOD FOR CONTROLLING A PLURAL STAGE COMPRESSOR

This invention relates to a method for controlling a plural stage compressor and a control system for implementing such a method.

In particular, it relates to the supply of natural gas to an engine or other machine for doing work. This engine, or machine, (and the compressor) may be on board on a vehicle (ship, train . . . ) or onshore. The gas at the inlet of the compressor comes for example from a storage of LNG (Liquefied Natural Gas). Therefore, it can be at low temperature (below −100° C.). It may be boil-off gas or vaporized liquid.

As well-known from a man having ordinary skill in matter of compressors, a compressor and also a plural stage compressor only works in given conditions which depend of the features of the compressor. The use of centrifugal compressors is limited on the one hand by stonewall conditions and on the other hand by surge conditions.

Stonewall occurs when the flow becomes too high relative to the head. For example, in a compressor with a constant speed, the head has to be greater than a given value.

Surge occurs when the flow of gas decreases in the compressor so that the compressor cannot maintain a sufficient discharge pressure. The pressure at the outlet of the compressor can then become lower than the pressure at the inlet. This can damage the compressor (impeller and/or shaft).

It is well known in the prior art to protect a compressor from surge condition by means of an "anti-surge" line which connect the outlet of the compressor with its inlets and fitted with a bypass valve.

U.S. Pat. No. 4,526,513 discloses a method and apparatus for control of pipeline compressors. This document concerns more particularly the surge conditions of compressors. However, it indicates that if stonewall is present, it is necessary to put additional compressor units on line. This solution cannot ever been applied and if it can, it is an expensive solution.

A first object of the present invention is the provision of a control system for a plural stage compressor for avoiding stonewall conditions.

A second object of the present invention is the provision of a control system for increasing the range for the inlet conditions of the compressor when some outlet conditions are set.

A third object of the invention is the provision of a control system with a limited surcharge compared to a control system adapted for avoiding surge conditions.

For meeting at least one of these objects or others, a first aspect of the present invention proposes a method for controlling a plural stage compressor comprising at least a first stage, a second stage and a first inter-stage line between the first stage and the second stage.

According to this invention, this method comprises the steps of:

a—measuring the temperature at the inlet of the compressor, b—measuring the ratio between the outlet pressure and the inlet pressure of the first stage of the compressor, c—calculating a coefficient based at least on the value of the inlet temperature and on the measured pressure ratio, d—if the calculated coefficient is in a predetermined range, acting on a control valve mounted in a line supplying the inlet of the first stage of the compressor or in a gas recycle line which opens into the first inter-stage line.

This method proposes to act on the working conditions of the first stage of the compressor. The inlet temperature and pressure and also the outlet pressure are measured. If the calculated coefficient is not in the predetermined range, the inlet temperature has to increase and/or the ratio from the outlet pressure by the inlet pressure has to increase.

In a first embodiment of this method, the coefficient calculated in step c may be a coefficient calculated by multiplying the inlet temperature of the compressor by a logarithm of the ratio of the outlet pressure by the inlet pressure.

A preferred embodiment of this method foresees that the coefficient calculated in step c is a head coefficient:

$$\psi=2*\Delta h/\cup^2$$

where:

Δh is the isentropic enthalpy rise in the first stage,

∪ is the impeller blade tip speed, and in that $$\Delta h=R*T\text{in}*\text{In}(P\text{out}/P\text{in})/\text{MW}$$

where:

R is a constant,

Tin is the temperature of the gas at the inlet of the first stage,

Pout is the pressure at the outlet of the first stage,

Pin is the pressure at the inlet of the first stage, and

MW is the molecular weight of the gas going through the compressor.

In this embodiment, it is supposed that the gas is an ideal gas and that the transformation is isentropic and adiabatic. This approximation gives good results into industrial realities.

In step d of the above described method, a control system may act:

on a bypass valve fitting a recycle line of the first stage of the compressor, and/or on a bypass valve fitting a recycle line which opens into the first inter-stage line, and/or on a control valve mounted on the main supply line of the compressor.

In these actions, it is possible to respectively increase the inlet temperature and/or increase the outlet pressure and/or decrease the inlet pressure of the first stage of the compressor.

The invention concerns also a plural stage compressor comprising:

a first stage of the compressor, at least a further stage of the compressor, a first inter-stage line between the first stage and the second stage, a temperature sensor for measuring the temperature at the inlet of the first stage, a first pressure sensor for measuring the pressure at the inlet of the first stage of the compressor, a second pressure sensor for measuring the pressure at the outlet of the first stage of the compressor, characterised in that it further comprises:

a first recycle line going from the outlet of the first stage of the compressor to the inlet of said first stage of the compressor and comprising a bypass valve, and means for implementing a method as described here above.

Such a plural stage compressor may further comprise:

a recycle line from the outlet of a $n^{th}$ stage of the compressor to the first inter-stage line and comprising a bypass valve, and/or a control valve mounted on the main supply line of the compressor.

A plural stage compressor may be a four-stage or a six-stage compressor.

In a compressor according to the invention, each stage may comprise an impeller, and all said impellers may be mechanically connected.

These and other features of the invention will be now described with reference to the appended figures, which relate to preferred but not-limiting embodiments of the invention.

FIGS. 1 to 4 illustrate four possible implementations of the invention.

Same reference numbers which are indicated in different ones of these figures denote identical elements or elements with identical function.

FIG. 1 shows a plural stage compressor which is in this example a four-stage compressor. Each stage 10, 20, 30, 40 of the compressor which is schematically shown on FIG. 1 comprises a centrifugal impeller with a fixed speed. The stages are mechanically coupled by a shaft and/or by a gearbox. The impellers can be similar but they can also be different, for example with different diameters.

A supply line 4 feeds gas to the compressor, more particularly to the inlet of the first stage 10 of the compressor. The gas can be for example boil-off gas from a storage tank on-board a boat or onshore.

After passing through the first stage 10, the gas is feed by a first inter-stage line 12 to the inlet of the second stage 20. After passing through the second stage 20, the gas is feed by a second inter-stage line 22 to the inlet of the third stage 30. After passing through the third stage 30, the gas is feed by a third inter-stage line 32 to the inlet of the fourth stage 40.

After the fourth stage 40 the compressed gas may be cooled in an aftercooler 5 before being led by a supply line 6 to an engine (not shown) or another device.

The compressor comprises a first recycle line 8 which may take compressed gas at the outlet of the first stage 10 and may supply it to the inlet of the first stage 10. A first bypass valve 70 controls the passage of gas through the first recycle line 8. As illustrated on the figures, the gas may be totally or partially or not cooled by an intercooler 72 before being sent in the inlet of the first stage. Downstream from the first bypass valve, the first recycle line 8 may have two branches, one fitted with the intercooler 72 and a control valve and the other with only a control valve.

In the example shown on FIG. 1, a second recycle line 74 is foreseen. It may take off compressed gas at the outlet of the fourth stage 40, preferably downstream of the aftercooler 5, and may supply it into the first inter-stage line 12, at the inlet of the second stage 20. A second bypass valve 76 controls the passage of gas through the second recycle line 74.

The compressor also comprises a temperature sensor 78, a first pressure sensor 80 and a second pressure sensor 82. The temperature sensor 78 measures the temperature of the gas at the inlet of the first stage 10. This sensor is disposed downstream from the junction of the first recycle line 8 with the supply line 4. The first pressure sensor 80 measures the pressure at the inlet of the first stage 10, for example at the same point than the temperature sensor 78 and the second pressure sensor 82 measures the pressure at the outlet of the first stage 10. The second pressure sensor 82 is for example integrated in the first inter-stage line 12 upstream from the derivation of the first recycle line 8.

Figure 3:
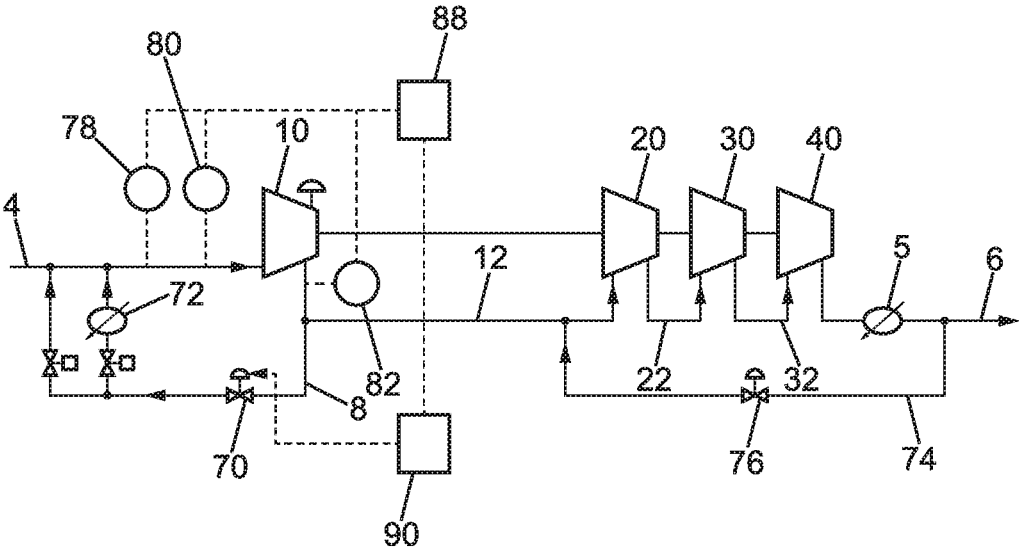

The compressor shown on FIG. 3 is also a four stage compressor and has the same structure than the compressor described here above in reference to FIG. 1.

Figure 2:
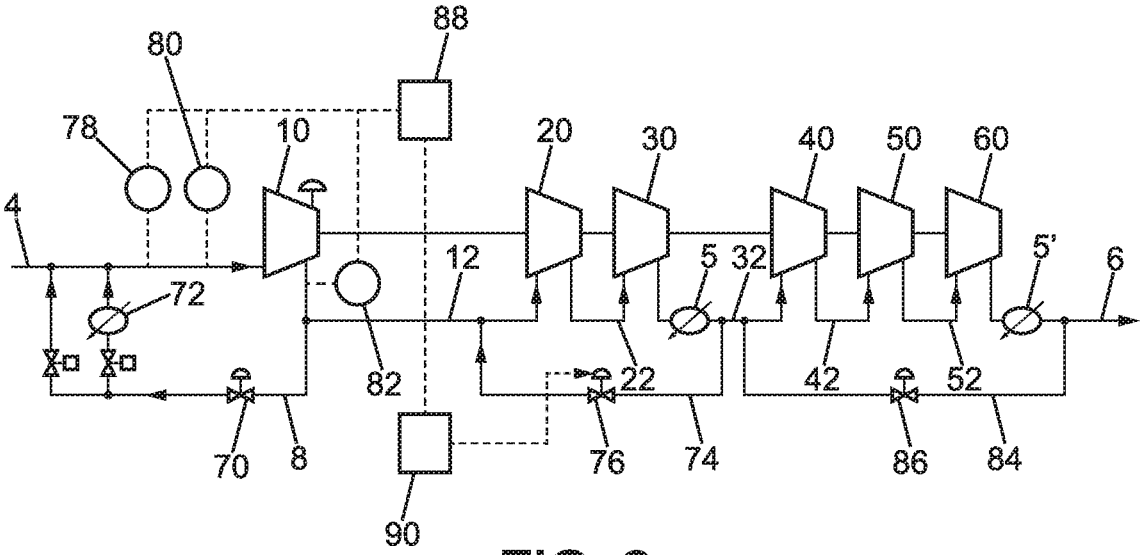

The compressor shown on FIG. 2 (and also on FIG. 4) is a six stage compressor. Each stage 10, 20, 30, 40, 50 and 60 of this compressor comprises also a centrifugal impeller and these impellers are mechanically connected through a shaft and/or a gearbox. The impellers can be similar but they can also be different, for example with different diameters.

One finds also on FIG. 2 a supply line 4 that feeds gas to the compressor, a first inter-stage line 12, a second inter-stage line 22 and a third inter-stage line 32. Since there are six stages in this compressor, this last also has a fourth inter-stage line 42 which connects the outlet of the fourth stage to the inlet of the fifth stage and finally a fifth inter-stage line 52 between the outlet of the fifth stage 50 of the compressor and the inlet of its sixth stage 60.

In this six-stage embodiment, the compressed gas may be cooled for example after the third stage 30 and after the sixth stage in an aftercooler 5, 5'. The aftercooler 5 is mounted in the third inter-stage line and the aftercooler 5' cools the compressed gas before it is led by supply line 6 to an engine (not shown) or another device.

The compressor shown on FIGS. 2 (and 4) also comprises a first recycle line 8 with a first bypass valve 70. The gas may also be partially or totally cooled by an intercooler 72 before being sent in the inlet of the first stage.

In the example shown on FIG. 2, a second recycle line 74 and a third recycle line 84 are foreseen. The second recycle line 74 may take off compressed gas at the outlet of the third stage 30, preferably downstream of the aftercooler 5, and may supply it into the first inter-stage line 12, at the inlet of the second stage 20. A second bypass valve 76 controls the passage of gas through the second recycle line 74.

The third recycle line 84 may take off compressed gas at the outlet of the sixth stage 60, preferably downstream of the aftercooler 5', and may supply it into the third inter-stage line 32, at the inlet of the fourth stage 40. The third recycle line 84 opens in the third inter-stage line 32 downstream from the derivation from the second recycle line 74. A third bypass valve 86 controls the passage of gas through the third recycle line 84.

The six-stage compressor also comprises a temperature sensor 78, a first pressure sensor 80 and a second pressure sensor 82 which are mounted in a similar way as in the four-stage compressor.

In a (four-stage or six-stage) compressor as described here above, or also in other plural stage compressor, the stonewall may be associated to a low head pressure with a high flow through the compressor stages. Operating in the stonewall area leads generally to vibrations and sometimes to damages to the compressor.

A method is now proposed for avoiding these vibrations and/or damages and avoiding the compressor (and more specifically stage 10) working with a low head pressure and a high flow.

According to this method, in a preferred embodiment, an isentropic head coefficient is calculated. It can be done continuously or periodically at a predetermined frequency. The frequency can be adapted if the temperature and pressure conditions may vary slowly or quickly.

The isentropic head coefficient is given by:

$$\psi=2*\Delta h/U^2$$

where:

Δh is the isentropic enthalpy rise in the first stage 10 of the compressor,

U is the impeller blade tip speed in the first stage 10 of the compressor.

The isentropic enthalpy rise is given by:

$$\Delta h=R*T\text{in}*\text{In}(P\text{out}/P\text{in})/\text{MW}$$

where:

R is the universal gas constant,

Tin is the temperature of the gas at the inlet of the first stage 10,

Pout is the pressure at the outlet of the first stage 10,

Pin is the pressure at the inlet of the first stage 10, and

MW is the molecular weight of the gas going through the compressor.

R value is approximately 8.314 kJ/(kmol K)

Tin is given in K

Pout and Pin are given in bar (a)

MW is given in kg/kmol

Then Δh is given in kJ/kg

The speed of the tip of the blades of the impeller of the first stage is given in m/s.

In a case where the composition of the gas does not vary, or only in a small scale, and where the rotation speed of the shaft 2 is constant:

$$\psi=\alpha*[T\text{in}*\text{In}(P\text{out}/P\text{in})]$$

It is now proposed to calculate ψ by adapted calculation means 88, which are integrated in the compressor. These calculation means receive information from the temperature sensor 78, from the first pressure sensor 80 and from the second pressure sensor 82. If the molecular weight of the gas can change, an information concerning the gas (coming for example from a densitometer and/or a gas analyser) may also be given to the calculation means. In the same way, if the speed of the impeller can change, a tachometer may be foreseen on the shaft 2.

The value of ψ is then given to electronic control means 90 which can command associated actuators foreseen in the compressor.

In the proposed method, as an illustrative but not limitative example, it will be considered that the compressor works next to the stonewall conditions if ψ is less than 0.2 (with the units given here above).

FIGS. 1 to 4 propose different ways to act on the compressor in order to vary coefficient ψ.

On FIG. 1, the electronic control means 90 are connected with an actuator adapted to act on the second bypass valve 76. In case ψ becomes equal to 0.2, the control means 90 act so that the second bypass valve 76 opens. This action will lead gas in the first inter-stage line 12. Since the rotation speed of the compressor of the second stage 20 does not vary, the volumetric gas flow through the second stage does not vary. As a consequence, the pressure at the inlet of the second stage will increase together with Pout of the first stage 10 and therewith Δh and also ψ by a constant speed of the impellers.

On FIG. 2, the action of the control means 90 is similar than on FIG. 1. Said means act on the second bypass valve 76 and increase the outlet pressure of the first stage 10. The difference between FIG. 1 and FIG. 2 is that FIG. 1 concerns a four-stage compressor and FIG. 2 a six-stage compressor.

On FIG. 3, the control means 90 are connected with an actuator adapted to act on the first bypass valve 70. The control principle is to regulate the isentropic head of the first stage 10 by recycling warm gas to the inlet of the first stage 10.

Here, in case ψ becomes equal to 0.2, the control means 90 act so that the first bypass valve 70 opens. This action will lead warm gas at the inlet of the first stage. As a consequence, Tin will increase and therewith Δh and also ψ by a constant speed of the shaft 2.

Figure 4:
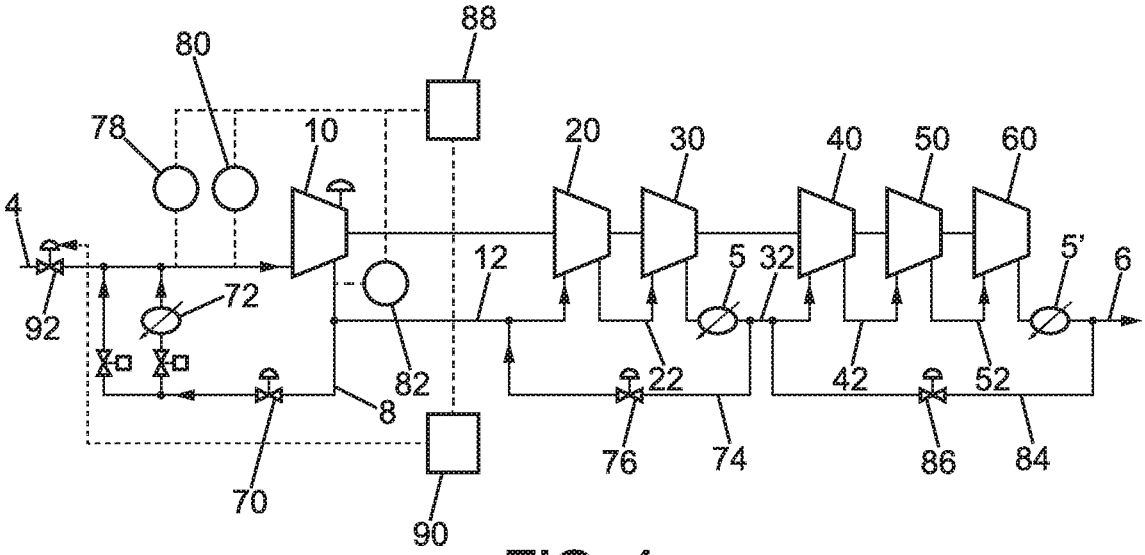

It seems to be clear to a man having ordinary skill in the art that this regulation also works on a six-stage compressor like the compressor of FIG. 2 or 4.

FIG. 4 proposes a third way to act on the value of ψ. In this embodiment, a control valve 92 is mounted on the main supply line 4 of the compressor. It is preferably mounted upstream from the first recycle line 8.

In this embodiment, the control means 90 are connected with an actuator adapted to act on the control valve 92. The control principle is to regulate the isentropic head of the first stage 10 by adapting the pressure at the inlet of the first stage 10.

Here, in case ψ becomes equal to 0.2, the control means 90 act so that the control valve 92 closes. As a consequence, Pin will decrease and therewith Δh and also ψ will increase by a constant speed of the shaft 2.

These three different method of regulation are based on the fact that the limitation concerning stonewall in a plural stage compressor comes from the first stage. They allow broadening in an important way the working conditions of the compressor.

For example, if the compressor works with boil-off gas like LNG boil-off gas, the inlet pressure at the first stage of the compressor may vary from 1.03 to 1.7 bara. The inlet temperature may also vary in a large scale, from −140° C. to +45° C. Since the composition of the gas may also vary, the density of the LNG may vary from 0.62 kg/m$^3$ (100% $CH_4$) to 2.83 kg/m$^3$ (85% $CH_4$ and 15% $N_2$).

Compressor stonewall for boil-off gas handling applications happens (depending from the composition of the gas) with high tank pressure combined to a low temperature. The proposed method allows the compressor working with higher pressures and/or lower temperatures compared to a prior art compressor. It has been tested that if the compressor is in the stonewall area with a pressure of 1.7 bara and a temperature of −100° C. without the proposed regulation, the compressor may work outside the stonewall area until a temperature of −140° C. with the proposed regulation.

Although in a preferred embodiment of the proposed method, an isentropic head coefficient is calculated, a method based on the calculation of another coefficient depending from the inlet temperature and from the ratio of the outlet pressure by the inlet pressure may also works. Preferably, the coefficient depends from $$T\text{in}*\text{In}(P\text{out}/P\text{in}).$$

An advantage of the proposed method is that it can work without changing a prior art compressor. The described bypass valves are usually used as anti-surge valves and are present on most of the prior art compressors. The proposed method uses these valves for another function.

A compressor as described here above may be used on a boat, or on a floating storage regasification unit. It can also be used onshore, for example in a terminal, or also on a vehicle for example a train. The compressor may supply an engine or a generator (or another working device).

Obviously, one should understand that the above detailed description is provided only as embodiment examples of the invention. However secondary embodiment aspects may be adapted depending on the application, while maintaining at least some of the advantages cited.

The invention claimed is:

1. A method for controlling a plural stage compressor comprising at least a first stage (10), a second stage (20) and a first inter-stage line (12) between the first stage (10) and the second stage (20), said method comprising:

(a) measuring the temperature at the inlet of the compressor, (b) measuring the ratio between the outlet pressure (Pout) and the inlet pressure (Pin) of the first stage (10) of the compressor, (c) calculating a coefficient OP) based at least on the value of the inlet temperature (Tin) and on the measured pressure ratio (Pout/Pin), (d) sending: the calculated coefficient (ψ) to an electronic control means (90), wherein said electronic control means (90) is adapted to act on: (i) an actuator that acts on a bypass valve (70) of a first recycle line (8) going from the outlet of the first stage (10) to the inlet of said first stage (10), (ii) an actuator that acts on a second bypass valve (76) of a second recycle line (74) between the outlet of said second stage to the first inter-stage line (12), and/or (iii) an actuator that acts on a control valve (92) mounted on a main supply line (4) of the compressor, and (e) if the calculated coefficient (ψ) is in a predetermined range, acting on said bypass valve (70) of said first recycle line (8), second bypass valve (76) of the second recycle line (74), and/or said control valve (92? mounted on the main supply line (4) of the compressor, and wherein the coefficient (ψ) calculated in (c) is a head coefficient calculated by multiplying the inlet temperature (Tin) of the compressor by a logarithm of the ratio of the outlet pressure by the inlet pressure (Pout/Pin) according to the following equation:

$$\psi=2*\Delta h/\cup^2$$

where:

Δh is the isentropic enthalpy rise in the first stage,

∪ is the impeller blade tip speed, and in that $$\Delta h=R*\mathrm{Tin}*\mathrm{In}(Pout/Pin)/\mathrm{MW}$$

where:

R is a constant,

Tin is the temperature of the gas at the inlet of the first stage,

Pout is the pressure at the outlet of the first stage,

Pin is the pressure at the inlet of the first stage, and

MW is the molecular weight of the gas going through the compressor.

2. The method according to claim 1, wherein in (e), said electronic control means (90) acts on said bypass valve (70) of said first recycle line (8).

3. The method according to claim 1, wherein in step (e), said electronic control means (90) acts on said bypass valve (76) of said second recycle line (74) which opens into the first inter-stage line (12).

4. The method according to claim 1, in (90) acts on said control valve (92) mounted on the main supply line (4) of the compressor.

5. A plural stage compressor comprising:

a first stage (10), at least a further stage (20, 30, 40, 50, 60), a first inter-stage line (12) between the first stage (10) and second stage (20), a temperature sensor (78) for measuring the temperature (Tin) at the inlet of the first stage (10), a first pressure sensor (80) for measuring the pressure (Pin) at the inlet of the first stage (10), a second pressure sensor (82) for measuring the pressure at the outlet of the first stage (10), a first recycle line (8) going from the outlet of the first stage (10) to the inlet of said first stage (10) and comprising a bypass valve (70), and means (88, 90) for implementing a method for controlling the plural stage compressor, said method comprising:

(a) measuring the temperature at the inlet of the compressor, (b) measuring the ratio between the outlet pressure (Pout) and the inlet pressure (Pin) of the first stage of the compressor, (c) calculating a coefficient (Y) based at least on the value of the inlet temperature (Tin) and on the measured pressure ratio (Pout/Pin), (d) sending the calculated coefficient (Y) to an electronic control means (90), wherein said electronic control means is adapted to act on: (i) an actuator that acts on the bypass valve (70) of the first recycle line (8) going from the outlet of the first stage to the inlet of said first stage, (ii) an actuator that acts on a second bypass valve (76) of a second recycle line (74) between the outlet of said second stage to the first inter-stage line (12), and/or an actuator that acts on a control valve (92) mounted on a main supply line (4) of the compressor, and (e) if the calculated coefficient (Y) is in a predetermined range, acting on said bypass valve (70) of said first recycle line (8), second bypass valve (76) of the second recycle line (74), and/or said control valve (92) mounted on the main supply line (4) of the compressor, and wherein the coefficient (Y) calculated in (c) is a head coefficient calculated by multiplying the inlet temperature (Tin) of the compressor by a logarithm of the ratio of the outlet pressure by the inlet pressure (Pout/Pin) according to the following equation:

$$\psi=2*\Delta h/\cup^2$$

Where:

Δh is the isentropic enthalpy rise in the first stage,

∪ is the impeller blade tip speed,

And in that $$\Delta h=R*\mathrm{Tin}*\mathrm{In}(Pout/Pin)/\mathrm{MW}$$

Where:

R is a constant,

Tin is the temperature of the gas at the inlet of the first stage,

Pout is the pressure at the outlet of the first stage,

Pin is the pressure at the inlet of the first stage, and

MW is the molecular weight of a gas going through the compressor.

6. The plural stage compressor according to claim 5, wherein said compressor includes at least one further stage downstream of the second stage and further comprises a second recycle line (74) from the outlet of said further stage to the first inter-stage line (12), said second recycle line (74) having a bypass valve (76).

7. The plural stage compressor according to claim 5, further comprising a control valve (92) mounted on a main supply line (4) of the compressor.

8. The plural stage compressor according to claim 5, wherein said compressor is a four stage compressor.

9. The plural stage compressor according to claim 5, wherein said compressor is a six stage compressor.

10. The plural stage compressor according to claim 5, wherein each stage comprises an impeller, and all of said impellers are mechanically connected.

11. The plural stage compressor according to claim 5, wherein the first recycle line (8), downstream from the first bypass valve, has a first branch and a second branch, wherein the first branch is fitted with an intercooler (72) and a control valve and the second branch is fitted with a control valve.

12. The plural stage compressor according to claim 5, wherein said compressor further comprises a third stage (30) downstream of the second stage (20) and at least a further stage, downstream of the third stage, a second inter-stage line (22) between the second stage and the third stage, a third inter-stage line (32) between the third stage and a stage downstream of the third stage, a second recycle line (74) from the outlet of said second stage to the first inter-stage line (12), and a third recycle line (84) from the outlet of said stage downstream of the third stage to the third inter-stage line (32), wherein said second recycle line (74) comprises a bypass valve (76) and said third recycle line (84) comprises a bypass valve (86).

13. The plural stage compressor according to claim 12, wherein an aftercooler (5) is mounted in the third inter-stage line (32) at a point upstream of the second recycle line (74).

14. A plural stage compressor comprising:

a first stage (10), at least a further stage (20, 30, 40, 50, 60), a first inter-stage line (12) between the first stage (10) and a second stage (20), a temperature sensor (78) for measuring the temperature (Tin) at the inlet of the first stage (10), a first pressure sensor (80) for measuring the pressure (Pin) at the inlet of the first stage (10), a second pressure sensor (82) for measuring the pressure (Pout) at the outlet of the first stage (10), a first recycle line (8) going from the outlet of the first stage (10) to the inlet of said first stage (10) and comprising a bypass valve (70), and a calculation means (88) which receives information from the temperature sensor (78), the first pressure sensor 80 and the second pressure sensor 82, wherein said calculation means (88) calculates a coefficient (Y) based at least on the value of the inlet temperature (Tin) and on the measured pressure ratio (Pout/Pin), and sends the calculated coefficient (Y) to an electronic control means (90), wherein the coefficient (Y) calculated is a head coefficient calculated by multiplying the inlet temperature (Tin) of the compressor by a logarithm of the ratio of the outlet pressure by the inlet pressure (Pout/Pin) according to the following equation:

$$\psi=2*\Delta h/\cup^2$$

Where:

Δh is the isentropic enthalpy rise in the first stage,

∪ is the impeller blade tip speed,

And in that $$\Delta h=R*\mathrm{Tin}*\mathrm{In}(Pout/Pin)/\mathrm{MW}$$

Where:

R is a constant,

Tin is the temperature of the gas at the inlet of the first stage,

Pout is the pressure at the outlet of the first stage,

Pin is the pressure at the inlet of the first stage, and

MW is the molecular weight of a gas going through the compressor, wherein said electronic control means (90) is adapted to act on: (i) an actuator that acts on the bypass valve (70) of the first recycle line (8), (ii) an actuator that acts on a second bypass valve (76) of a second recycle line (74) between the outlet of said second stage to the first inter-stage line (12), and/or (iii) an actuator that acts on a control valve (92) mounted on a main supply line (4) of the compressor.

* * * * *